US005474204A

United States Patent [19]

Sutyla

[11] Patent Number: 5,474,204

[45] Date of Patent: Dec. 12, 1995

[54] PORTABLE CONTAINER WITH SEPARATE COMPARTMENTS

[76] Inventor: William Sutyla, Box 28, Arborg, Manitoba, Canada, R0C 0A0

[21] Appl. No.: 273,118

[22] Filed: Jul. 11, 1994

[51] Int. Cl.[6] ..... B65D 25/04

[52] U.S. Cl. ..... 220/507; 220/504; 220/528; 220/552; 220/345

[58] Field of Search ..... 220/504, 503, 220/507, 528, 529, 552, 4.31, 4.32, 4.28, 692, 345, 346, 525

[56] References Cited

U.S. PATENT DOCUMENTS

| | | | |
|---|---|---|---|
| 949,204 | 2/1910 | Stiehl | 220/4.31 |
| 1,308,821 | 7/1919 | Tripp | 220/552 |
| 1,439,450 | 12/1922 | Scott | 220/4.31 |
| 1,688,887 | 10/1928 | Spreen | 220/552 |
| 2,562,248 | 7/1951 | Weed | 220/345 |
| 2,563,368 | 8/1951 | Refsdal | 220/504 |
| 2,868,360 | 1/1959 | Donkin | 220/507 |
| 3,288,325 | 11/1966 | Fulton | 220/4.31 |
| 3,817,372 | 6/1974 | Smith | 220/504 |
| 4,065,021 | 12/1977 | Kedzierski | 220/552 |
| 4,844,279 | 7/1989 | Chalat | 220/504 |

FOREIGN PATENT DOCUMENTS

| | | | |
|---|---|---|---|
| 1355546 | 2/1964 | France | 220/507 |

*Primary Examiner*—Stephen J. Castellano

*Attorney, Agent, or Firm*—Adrian D. Battison; Murray E. Thrift

[57] ABSTRACT

A container having a plurality of compartments for screws and the like is defined by a box having side walls and end walls leaving faces at right angles to the side and end walls open. Inside the box is inserted a convoluted or castillated divider sheet separating the box transversely into a plurality of separate compartments together with a divider plate parallel to the open faces and separating the compartments into upper and lower sections. The side and end walls each have outwardly extending flanges lying in the plane of the open face so that a door can slide over the flanges with channels at either edge of the door to hold the door in place. A handle is located on one side wall for carrying the container.

10 Claims, 5 Drawing Sheets

PORTABLE CONTAINER WITH SEPARATE COMPARTMENTS

FIELD OF THE INVENTION

This invention relates to a portable container with separate compartments for storing screws and similar small items in an organized manner, for example for the tradesman, home handyman and the like.

BACKGROUND

Various arrangements of storage container have been provided with a plurality of compartments for receiving screws and the like. Often these are relatively complicated and hence they are either expensive or if they are inexpensive they tend to be relatively weak and hence cannot stand up to the rigors of constant use. Often such containers with compartments of this type are manufactured from plastic which can be molded relatively inexpensively but again cannot stand up to the rigors of heavy use.

In addition, often the handle for supporting the container during portability is located at a top of the handle which interferes with the closure so that the strength of the container is reduced in view of this interference between the two elements.

SUMMARY

It is one object of the present invention, therefore to provide an improved container which is readily portable and is manufactured from sheet metal so as to be of sufficient strength to withstand constant use and yet is of a simple, inexpensive nature.

According to the invention, therefore, there is provided a portable container formed from sheet metal comprising a container body having two side walls and two end walls interconnected to form a hollow rectangular box; the side and end walls defining a first and a second opposed parallel face, at right angles to the side and end walls, which first and second opposed faces are open; a handle on one side wall by which the body can be lifted and carried suspended from the handle; divider sheet means in the box parallel to the opposed faces separating the box into a first part adjacent said first opposed face and a second part adjacent said second opposed face; means dividing each of said first and second parts into a plurality of separate compartments within the box, first and second door means each associated with a respective one of said first and second opposed faces for closing the respective opposed face and cooperating engagement means on each of said side walls and on each of said door means allowing sliding movement of the door means from a closed position closing the respective opposed face longitudinally of the side walls toward one end wall for opening of the compartments on the adjacent side of the divider sheet means.

BRIEF DESCRIPTION OF THE DRAWINGS

One embodiment of the invention will now be described in conjunction with the accompanying drawings in which.

DETAILED DESCRIPTION

Figure 1:
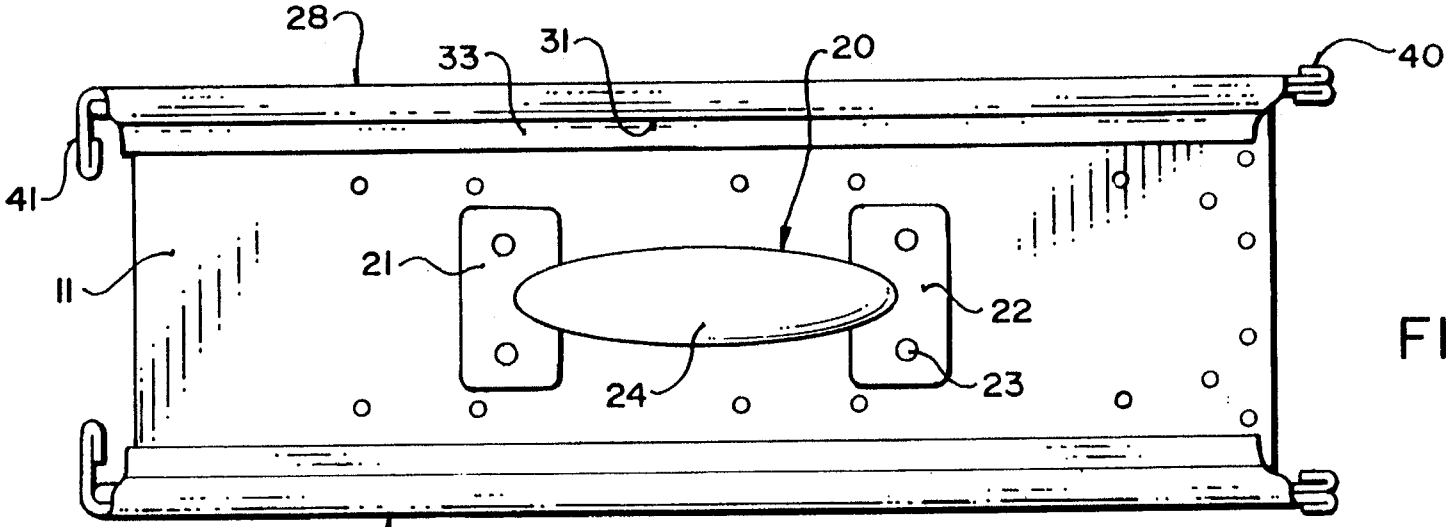
FIG. 1 is a top plan view of the container according to the present invention.

The container comprises a hollow box 10 defined by a first side wall 11, a second opposed, parallel side wall 12, a first end wall 13 and a second opposed, parallel end wall 14. Thus the end walls lie at right angles to the side walls and are connected thereto to form an integral structure. In particular, the box 10 is formed from two pieces which are identical with one of the pieces being defined by the side wall 11 and the end wall 13 and the other of the pieces being defined by the side wall 12 and the end wall 14. In order to provide interconnection between the two pieces, each of the pieces includes a flange 15 connected to an end of the end wall remote from the attached side wall and parallel thereto so that the flange 15 interconnects with an inside surface of the end of the side wall of the other of the pieces. Thus the flange 15 of the end wall 14 lies on the inside surface of the side wall 11 and is connected thereto by rivets 16.

Figure 3:
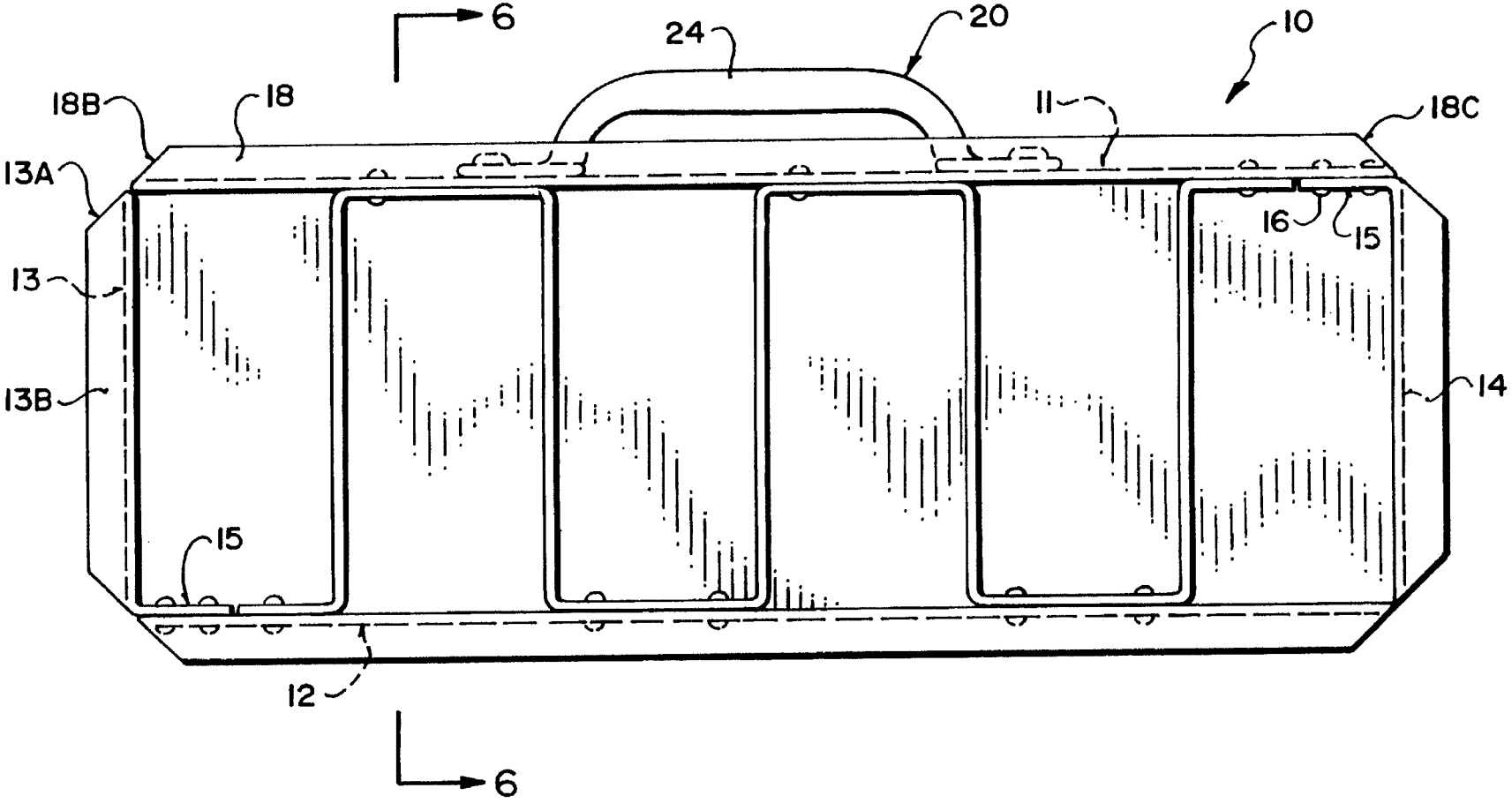
FIG. 3 is the same side elevation view as that of FIG. 2 with the door panel in open position and fully removed.

Each of the side walls and the end walls has a pair of flanges turned at right angles thereto at the respective edges of the wall. Thus for example, the side wall 11 includes flanges 18 and 19 which are turned at right angles to the side wall 11 and are formed by bending of the sheet metal defining the side wall 11. Each of the flanges 18 and 19 includes a second flange portion 18A, 19A which is turned back through 180 degrees relative to the flange 18, 19 so as to lie parallel thereto and pointed back towards the side wall 11. The flanges on each of the walls thus provide structural strength for the walls so that the box is structurally rigid by the interconnection between the wails and by the flanges at each edge of each of the walls. Each flange is chamfered at its ends as indicated for example in FIG. 3 where the flange 18 is shown and has end chamfered portions 18B and 18C. These chamfered portions thus lie at 45 degrees to the associated side wall 11. It will be noted therefore that the end edge 18B of the flange 18 lies on a common diagonal line with an end edge 13A of the flange 13B on the end wall 13.

A handle 20 is mounted on the outside surface of the side wall 11. The handle includes two end pads 21 and 22 which are fastened to the outside surface of the side wall 11 by screws 23. Between the pads 21 and 22 is provided an upstanding elongate handle bar 24 by which the hand of the user can grasp the handle by the fingers engaging under the bar in a space between the underside of the bar and the upper surface of the side wall 11. In this way, the box can be grasped by the user supporting the box by the handle with the box suspended downwardly from the handle. In this orientation, the side wall 11 becomes a top wall and the side wall 12 becomes a bottom wall.

The flanges at one edge of the side walls, for example the flange 18, all lie in a common plane at right angles to the side walls and end walls. Inside the flanges, the side walls and end walls define an open face. A similar situation is constructed at the opposed face of the box so that the box has two such open faces shown in FIG. 6 at 25 and 26.

Figure 2:
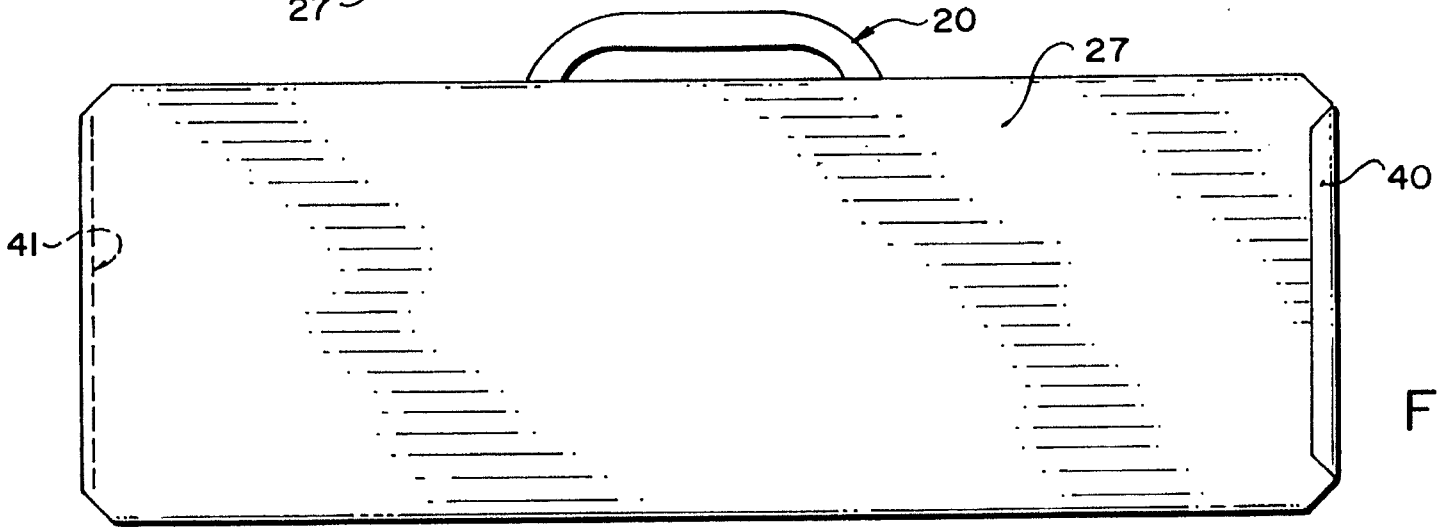
FIG. 2 is a side elevational view of the container of FIG. 1 with the door panel thereon in closed position.

Each open face of the box can be closed by an associated sliding door 27, 28. Each of the doors 27, 28 includes a door panel which is planar and dimensioned to just cover the respective end face and the flanges surrounding the end face. The door panel is indicated at 29 in FIG. 6. Each door further includes at top and bottom edges of the door panel 29 a rearwardly-turned flange portion 30, 31. Each of the flange portions 30, 31 is turned back to 180 degrees so as to lie parallel to the door panel 29 and spaced therefrom so as to define a hollow area 32 between the flange and the door panel for receiving the flange 19, 19A of the side wall. Thus the door panel can be inserted onto the flanges 19 from one end of the box and can slide longitudinally of the box to take up the position shown in FIG. 2.

In order to guide the door panel in the sliding movement, a second flange portion 33 is provided which extends from the edge of the flange portion 31 away from the door panel and is at right angles to the door panel. On an outer edge of the flange portion 33 is provided a further flange portion 34 which is turned back through 180 degrees so is lied parallel to the flange portion 33. The flange portion 34 thus sits against the outside surface of the associated side wall. The flange portion 34 thus acts in a sliding action to guide the door and to support the door.

The chamfered edges 18B, 13A previously described allow the door panel to slide easily onto the flanges of the side walls with the inclined line thus defined guiding the recessed area 32 in the required direction for the sliding movement longitudinally of the box.

At one end of the door panel, the metal from the door panel is turned back through 180 degrees to form a flange 40 lying flat against the door panel. At an opposed end of the door panel, the metal forming the door panel is turned at right angles to the door panel to form an end stop flange 41 which engages the flange of the end wall to locate the door panel in the closed position.

Figure 4:
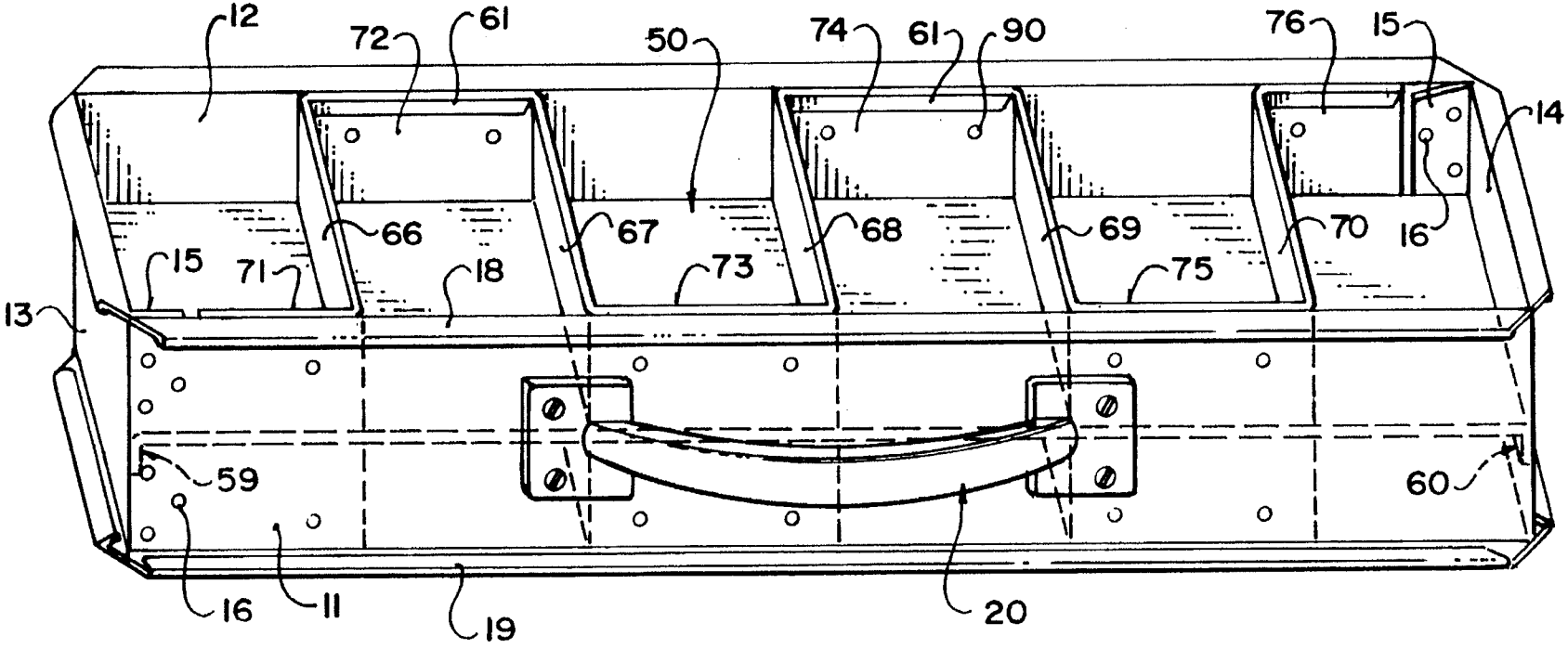
FIG. 4 is an isometric view of the container of FIG. 1 showing one side wall with the handle thereon and showing one open face with the door panel removed.
Figure 5:
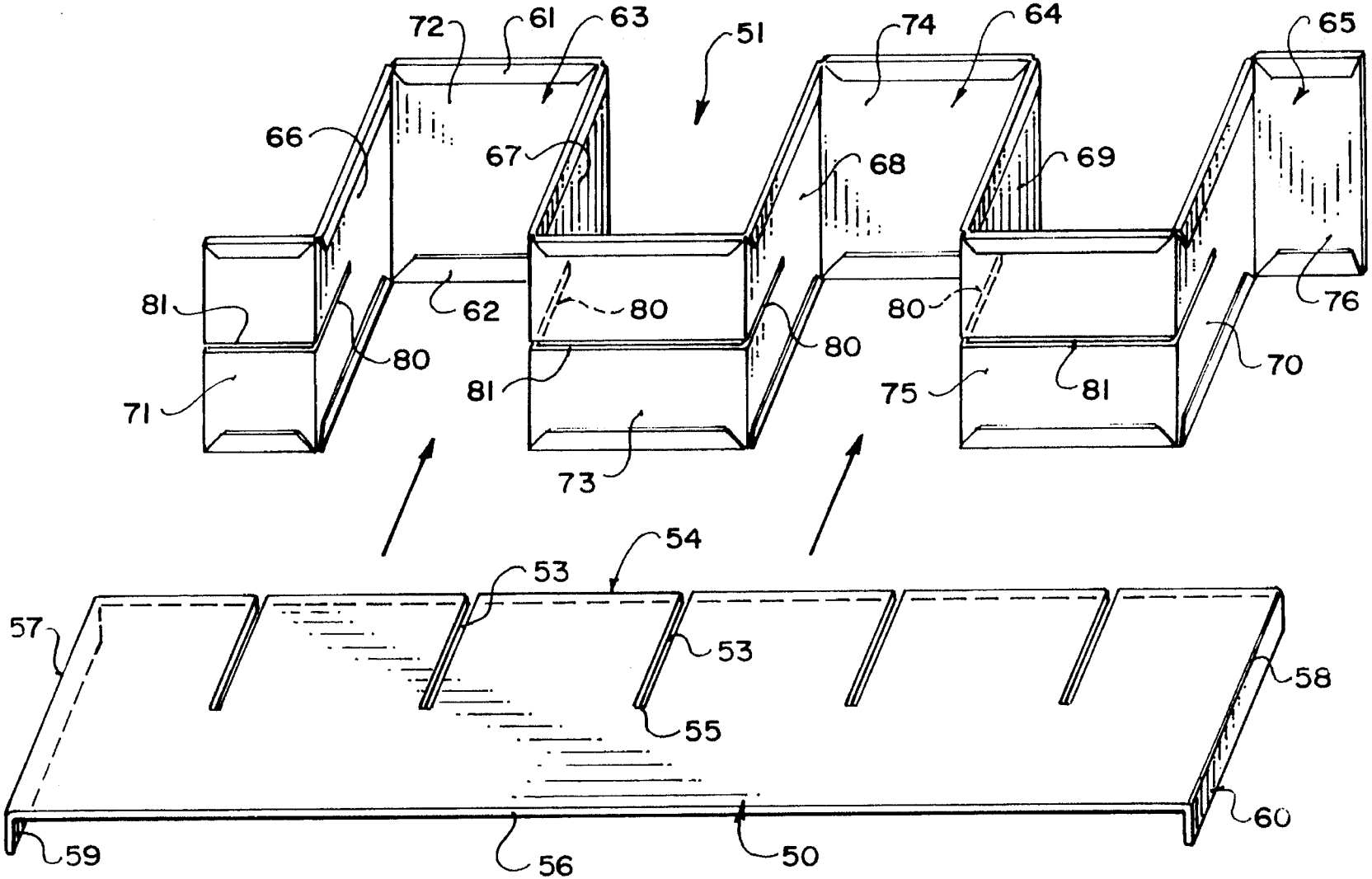
FIG. 5 is a schematic illustration showing an assembly step for manufacturing the divider sheet and compartments of the container of FIG. 1.

The box is divided into a plurality of compartments by a divider system shown schematically in FIG. 5. The divider system includes a divider sheet 50 and a convoluted compartment divider element 51. The sheet 50 is simply a flat sheet with a plurality of slots 53 at spaced positions along the length of the plate 50. The slots 53 extend from an edge 54 of the plate to a position 55 midway across the plate toward an opposed edge 56 of the plate. End edges 57 and 58 of the plate are turned downwardly to form flanges 59 and 60 which lie against the inside surface of the end walls 13 and 14 as best shown in FIG. 4.

The divider member 51 is formed from a sheet of metal which initially has top and bottom edges 61 and 62 which are turned back through 180 degrees to lie flat against the metal sheet. The metal sheet forming the divider member is then bent about transverse lines in parallel spaced arrangement so as to form a plurality of castillations 63, 64, 65. This forms a divider member into divider walls 66, 67, 68, 69 and 70 and connecting walls 71 through 76. The length of the divider wails 66 through 70 is equal to the length of the end walls so that the connecting walls 71 through 76 alternately lie against the side walls 11 and 12. The height of the divider walls and the height of the coupling walls is equal to the distance between the open faces of the box so that the edges defined by the flanges 61 and 62 lie in the plane of the open faces 25 and 26.

Figure 6:
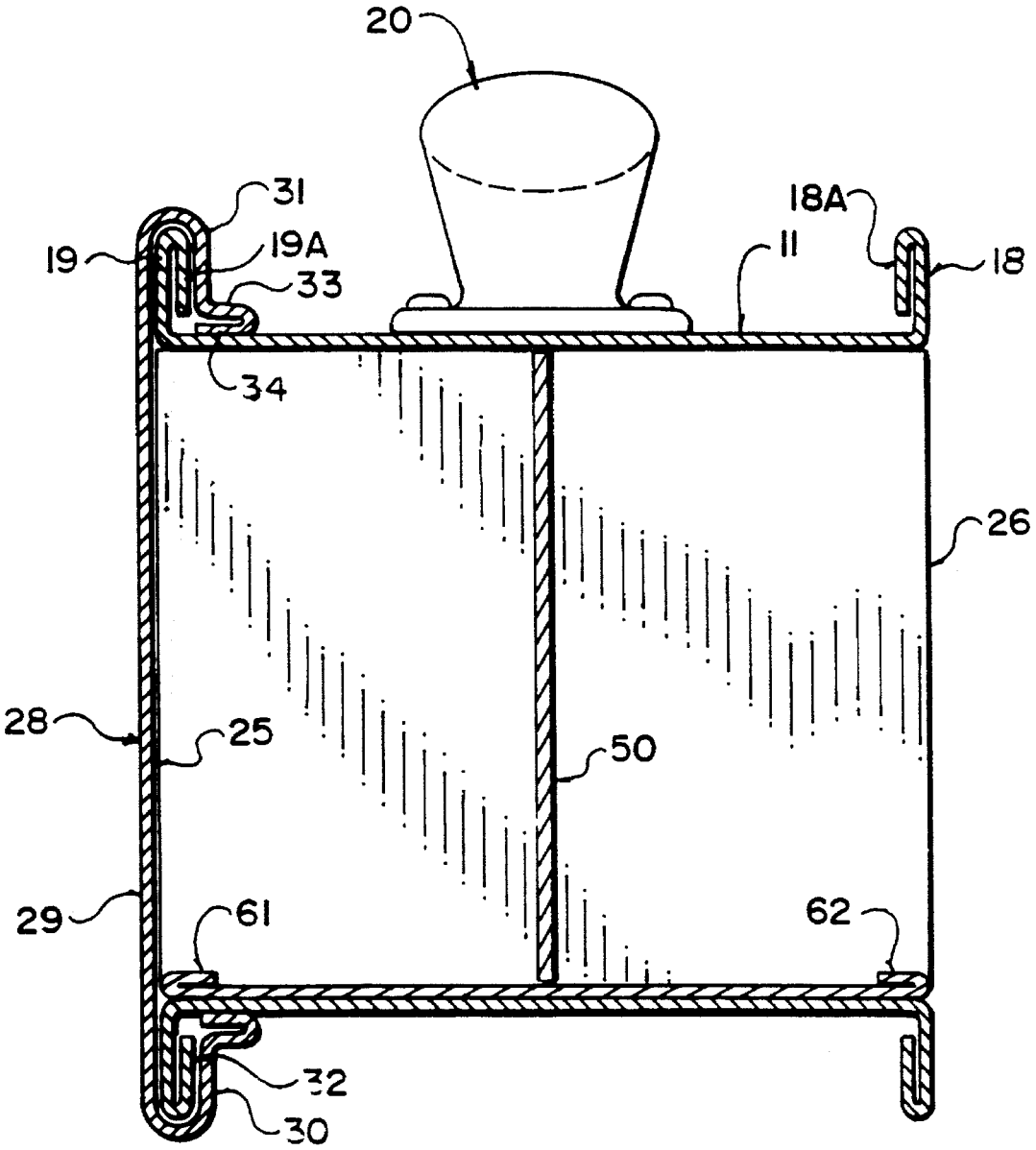
FIG. 6 is a cross-sectional view along the lines 6—6 of FIG. 3.

The divider walls 66 through 70 each include a slot 80 similar to the slots 53. The slots 80 are interconnected across the coupling walls 71, 73 and 75 by slots 81. It will be apparent therefore that in the assembly as shown in FIG. 5, the divider plate 50 is moved toward the divider member 51 so that the edge 54 of the divider plate passes through the slots 81 and into the slots 80. The slots 53 then engage over that part of the divider walls beyond the base of the slots 80 and similarly the slots 80 engage over that part of the divider plate beyond the ends 55 of the slots 53. This allows the divider plate to slide into position across the center of the divider member so as to separate the divider member into upper and lower compartments. Once assembled, the divider plate and the divider member are inserted into the box as shown in FIGS. 4 and 6 to divide the box into the plurality of different compartments. One set of the compartments is arranged on one side of the divider plate facing the open face 25 and the other set of compartments is arranged on the opposed side of the divider plate facing the open face 26. The coupling plates are then fastened to the side walls 11 and 12 by rivets 90. The length of the end coupling plates 71 and 76 is reduced so that the edges of the end coupling plates 71 and 76 lie closely adjacent but do not overlap the edges of the flanges 15.

When assembled into the construction shown in FIGS. 4 and 6, the door panels can slide into the closed position closing the compartments.

When it is desired to access one set of the compartments, the box is laid on one door panel with the opposed door panel facing upwardly. This allows the door panel to slide away from the box to the open position with the compartments facing upwardly for access. The compartments on the other open face are accessed by replacing the first door panel, inverting the box and by removing the second door panel.

While one embodiment of the present invention has been described in the foregoing, it is to be understood that other embodiments are possible within the scope of the invention. The invention is to be considered limited solely by the scope of the appended claims.

I claim:

1. A portable container comprising:

a container body having two side walls and two end walls each formed from sheet metal with the side and end walls interconnected to form a hollow rectangular box;

edges of the side and end walls defining first and second opposed parallel faces, at right angles to the side and end walls, which first and second opposed faces are open;

a handle on one side wall by which the body can be lifted and carried suspended from the handle;

a planar inner divider sheet in the box parallel to the opposed faces separating the box into a first part adjacent said first opposed face and a second part adjacent said second opposed face;

means dividing each of said first and second parts into a plurality of separate compartments within the box;

first and second door means each associated with a respective one of said first and second opposed faces for closing the respective opposed face;

and cooperating engagement means on each of said side walls and on each of said door means allowing sliding movement of the door means from a closed position closing the respective opposed face longitudinally of the side walls toward one end wall for opening of the compartments on the adjacent side of the inner divider sheet:

wherein the dividing means comprises an elongate strip of sheet metal which includes a plurality of transverse, parallel right angle bends forming between the bends a plurality of parallel divider walls and a plurality of parallel coupling walls at right angles to the divider walls, such that the divider walls alternate along the strip with the coupling walls, the dividing means being mounted in the container body such that each of the divider walls and each of the coupling walls is at right angles to the first and second faces and such that alternate ones of the coupling walls lie in contact with an inside surface of and attached to respective ones of the side walls of the box with the divider walls at right angles to the side walls and parallel to the end walls, each divider wall being spaced from the next so as to define a respective one of the compartments therebetween;

wherein the planar inner divider sheet includes a plurality of parallel slots therein extending from one side edge partly thereacross with a space between each slot and a next adjacent slot being equal to a width of a respective one of the compartments;

and wherein the dividing means includes a plurality of slots therein cooperating with the slots of the divider sheet and arranged so as to extend fully across alternate ones of the coupling walls and partly across each of the divider walls from an edge of the divider wall at said alternate ones of the coupling wall such that the divider sheet extends across the dividing means at a position thereon part way between the opposed faces.

2. The container according to claim 1 wherein each side wall has a pair of flanges, each flange being arranged along an edge of the side wall adjacent a respective one of the opposed faces, the flanges being arranged at right angles to the side walls and parallel to the opposed faces, said flanges defining that part of the cooperating engagement means on the side walls for engaging the door means in said sliding movement.

3. The container according to claim 2 wherein the flange on each edge of each side wall is formed from an integral edge portion of the side wall turned outwardly at right angles to the side wall and includes a second portion turned back parallel to the flange.

4. The container according to claim 2 wherein each end wall includes a pair of flanges, each flange lying along an edge thereof whereby each opposed face lies in a plane containing flanges defined by the end and side walls.

5. The container according to claim 1 wherein the box is formed from two pieces, each piece including one side wall and one end wall and a coupling piece for overlapping the other of the pieces for connection of the two pieces into the rectangular box.

6. The container according to claim 4 wherein the flanges are chamfered at corners of the box so as to define a line at adjacent ends of the flanges which is diagonal to the sides and end walls.

7. The container according to claim 1 wherein each door means comprises a planar sheet defining a door, panel and a pair of flanges at edges of the door panel turned back, relative to the door panel so as to lie parallel thereto and spaced therefrom.

8. The container according to claim 7 wherein each of the flanges of the door means includes a second flange portion turned at right angles thereto and extending away from the door panel.

9. The container according to claim 8 wherein each of the second flange portions of the door means includes a third flange portion turned through 180 degrees so as to lie parallel to the second flange portion and extending back towards the door panel.

10. The container according to claim 7 wherein each door panel includes an inwardly-turned end flange at right angles to the door panel for engaging an end wall of the box to locate the door panel in the closed position thereof.

* * * * *